United States Patent [19]

Rose et al.

[11] 4,037,290

[45] July 26, 1977

[54] VACUUM CLEANING DEVICE

[75] Inventors: James J. Rose, Sylmar; Edward L. Horton, San Gabriel, both of Calif.

[73] Assignee: Enviro-Blast International, Los Angeles, Calif.

[21] Appl. No.: 608,045

[22] Filed: Aug. 27, 1975

Related U.S. Application Data

[60] Division of Ser. No. 518,579, Oct. 29, 1974, Pat. No. 3,916,568, which is a continuation-in-part of Ser. No. 483,357, June 26, 1974, abandoned, which is a continuation of Ser. No. 360,192, May 14, 1973, abandoned.

[51] Int. Cl.[2] ..... A47L 5/14

[52] U.S. Cl. ..... 15/345; 15/340; 15/354; 15/409

[58] Field of Search ..... 15/345, 346, 340, 359, 15/409, 354

[56] References Cited

U.S. PATENT DOCUMENTS

| | | | |
|---|---|---|---|
| 1,037,027 | 8/1912 | Lindberg | 15/359 |
| 1,556,021 | 10/1925 | Orr | 15/354 X |
| 1,998,851 | 4/1935 | Shields | 15/345 |
| 2,012,640 | 8/1935 | Shipman | 15/346 |
| 3,222,707 | 12/1965 | Allenbaugh | 15/345 |
| 3,755,851 | 9/1973 | Williams | 15/346 |
| 3,778,864 | 12/1973 | Scherer | 15/345 X |

FOREIGN PATENT DOCUMENTS

| | | | |
|---|---|---|---|
| 516,294 | 1/1931 | Germany | 15/345 |
| 744,466 | 2/1956 | United Kingdom | 15/345 |

*Primary Examiner*—Christopher K. Moore
*Attorney, Agent, or Firm*—Paul A. Weilein

[57] ABSTRACT

To remove particles of debris from a floor surface, a hood is mounted on wheels to move over the floor with the open side of the hood facing downward to form a traveling chamber. An air jet nozzle inside the hood is directed downward and is moved in a circular horizontal orbit by a variable speed motor to agitate the debris particles as the hood travels. A pump is attached to the hood to maintain a vacuum therein and to withdraw from the hood a high velocity air stream entraining the agitated debris particles. The hood is manually steered and is driven by a variable speed motor.

19 Claims, 6 Drawing Figures

AIR LINE
V-1
V-2
AIR CLEANER 10
51
50
5
5

VACUUM CLEANING DEVICE

CROSS REFERENCE TO RELATED APPLICATION

This application is a division of our copending application Ser. No. 518,579, filed October 29, 1974, now Patent No. 3,916,568, issued November 4, 1975, which application is a continuation-in-part of Ser. No. 483,357 filed June 26, 1974 now abandoned, which application is a continuation of Ser. No. 360,192, filed May 14, 1973, now abandoned.

BACKGROUND OF THE INVENTION

This invention relates to a vacuum cleaner for removing foreign matter and debris from a floor surface. A conventional vacuum cleaner of this type comprises a hood which is movable along a floor surface with the open side of the hood turned towards the floor surface to cooperate therewith. A suction pump is connected to the hood by a suction conduit to create an air stream in the suction conduit which carries the foreign particles and debris to a suitable collection means such as a perforate bag. It is common to provide such a vacuum cleaner with mechanical means to agitate the foreign particles and debris on the floor and thus facilitate entrainment of the particles in the suction air stream. In a conventional vacuum cleaner the means for agitating the particles on the floor surface is commonly in the form of a rotary brush.

SUMMARY OF THE INVENTION

The hood is mounted by springs on wheels that include drive wheels with provision for manual steering as the drive wheels are actuated by a variable speed motor. For adjustment of the clearance space between the hood and the floor surface, the hood is vertically adjustable on a frame that carries the wheels and in addition the hood is equipped with vertically adjustable circumferential skirt means.

The primary object of the invention is to provide a highly effective means for agitating the particles on the floor surface that are to be removed by the suction stream. For this purpose instead of employing mechanical means such as a rotary brush, the invention provides the interior of the hood with a nozzle to direct a jet stream of compressed air against the floor surface to agitate the foreign particles and make them airborne to facilitate entrainment of the particles by the suction air stream.

Another object of the invention is to actuate an air jet nozzle inside the traveling hood in a manner conducive to effective coverage of the floor surface. Broadly described, this object is accomplished by cyclically shifting the air jet nozzle alternately towards the opposite sides of the hood. In the preferred practice of the invention the air jet nozzle is continuously moved in a horizontal circular orbit.

A feature of the invention is the manner in which the air jet nozzle is supported and actuated for orbital movement and the manner in which the orbiting nozzle is supplied with compressed air. A rotary structure inside the hood having a vertical axis of rotation is carried by a vertical tubular support that is journalled in a first bearing in the top wall of the hood. The air jet nozzle is located on the rotary structure at a radial distance from the axis of rotation for the purpose of the orbital movement of the nozzle. A hose carrying the compressed air stream extends into the hood through the tubular support along the axis of rotation of the rotary structure with an end portion of the hose diverging from the axis to the off-center blast nozzle. The air jet nozzle itself is mounted on the rotary structure by a second lower bearing. The air hose is not intended to rotate on its own axis and preferably is effectively clamped to resist such rotation. Thus, the divergent end of the clamped hose is moved in the circular orbit by the second bearing on the rotary structure that embraces the air jet nozzle, the second bearing rotating relative to the non-rotating air jet nozzle that it embraces.

Stability of the rotary structure is achieved by providing a counterbalance for the air jet nozzle with the counterbalance located diametrically across the circular orbit from the location of the air jet nozzle. Both the distance of the air jet nozzle from the axis of rotation and the distance of the counterweight from the axis of rotation are adjustable to permit change in the diameter of the circular orbit. With a given air jet stream and a given rate of travel of the hood, the abrasive affect of the air jet stream on the floor surface may be intensified by narrowing the orbit of the air jet nozzle or vice versa and by lowering the orbit or vice versa.

The hood is provided at its bottom rim with a skirt structure of rubber-like material that extends towards the floor and that readily yields to minor obstacles projecting from the floor, such as rivets, bolt heads, and the like. In the preferred embodiment of the invention the hood is provided with an outer skirt and an inner skirt both of which bend radially inwardly at floor level. A circumferential brush reinforces the outer skirt from the inside of the skirt against inward collapse of the outer skirt and spring members extending downward from the inner wall of the hood reinforce the inner skirt against inward collapse.

A further object of the invention is to prevent pollution of the atmosphere by the solid particles that are agitated by the air jet nozzle and also to prevent accumulation of such particles inside the traveling hood. For this purpose air is withdrawn from the traveling hood at a sufficiently high rate to maintain a relatively high vacuum in the hood. The high vacuum prevents escape of the solid particles from the hood by creating effective radially inward flow of air under the bottom of the circumferential skirt structure of the hood. The orbiting air jet nozzle thoroughly agitates the solid particles inside the hood to insure that the solid particles are entrained by the outgoing high velocity discharge stream.

The invention teaches that important advantages may be achieved by using a jet air pump to create the high velocity suction stream from the interior a rate of the hood. For this purpose the inlet end of a diffuser is attached to the hood and compressed air is fed to a jet nozzle in the inlet end of the diffuser. One advantage of this arrangement is that such an air pump is capable of creating as high of discharge flow as may be needed for efficient operation of the apparatus. Another advantage is that a jet air pump has no moving parts and is exceptionally light in weight. A further advantage is that the jet air pump may be actuated from the same source of compressed air as the orbiting air jet nozzle.

This versatility of the apparatus makes possible impressive savings, for example, in the sandblasting of the interior of an upright storage tank. Sandblasting the upright inner surfaces of such a tank results in the accumulation on the floor surface of a deep layer of the solid particles that are created by the sandblast operation. It has been found that one-third of the total cost of sandblasting the interior of an upright tank is in the cost of removing the accumulated deposit of solid particles in the heretofore prevalent manner. With the present apparatus functioning as a vacuum cleaner, the layer of accumulated particles may be removed expeditiously with no manual labor. After the accumulated layer of solid particles is removed by the vacuum operation, the apparatus The features and advantages of the invention may be understood from the following detailed description and the accompanying drawings.

BRIEF DESCRIPTION OF THE DRAWINGS

In the drawings, which are to be regarded as merely illustrative.

DESCRIPTION OF THE PRESENTLY PREFERRED EMBODIMENT OF THE INVENTION

Figures 1, 1A:
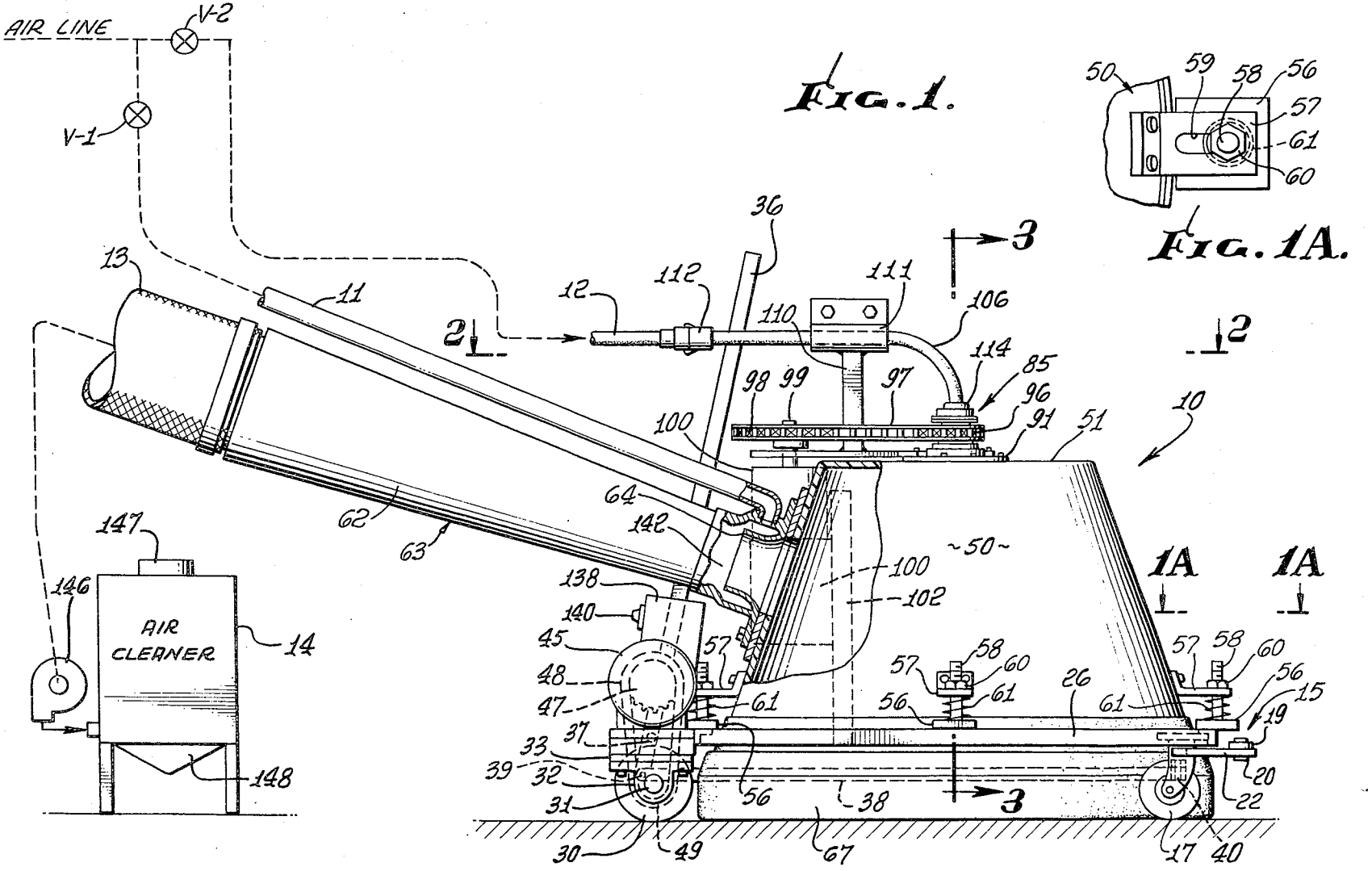
FIG. 1 shows the presently preferred embodiment of the invention in side elevation with portions broken away and additionally shows diagrammatically a system for supplying the apparatus with compressed air.
FIG. 1A is a fragmentary enlarged plan view as seen along the line 1A—1A of FIG. 1 showing one of the circumferentially spaced brackets for yieldingly mounting the hood on a frame that is equipped with ground wheels.

The drawings show a presently preferred embodiment of the vacuum cleaning device for removing debris from a floor surface, which device is generally designated by reference numeral 10. A hose 11 supplies compressed air for a jet-type suction pump of the apparatus and a hose 12 supplies the required stream of compressed air for agitating the debris on the floor surface. As shown diagrammatically in FIG. 1, an air line from a source of compressed air has a branch with a valve V-1 connected to hose 11 and has a branch with a valve V-2 that is connected to the hose 12.

Figure 2:
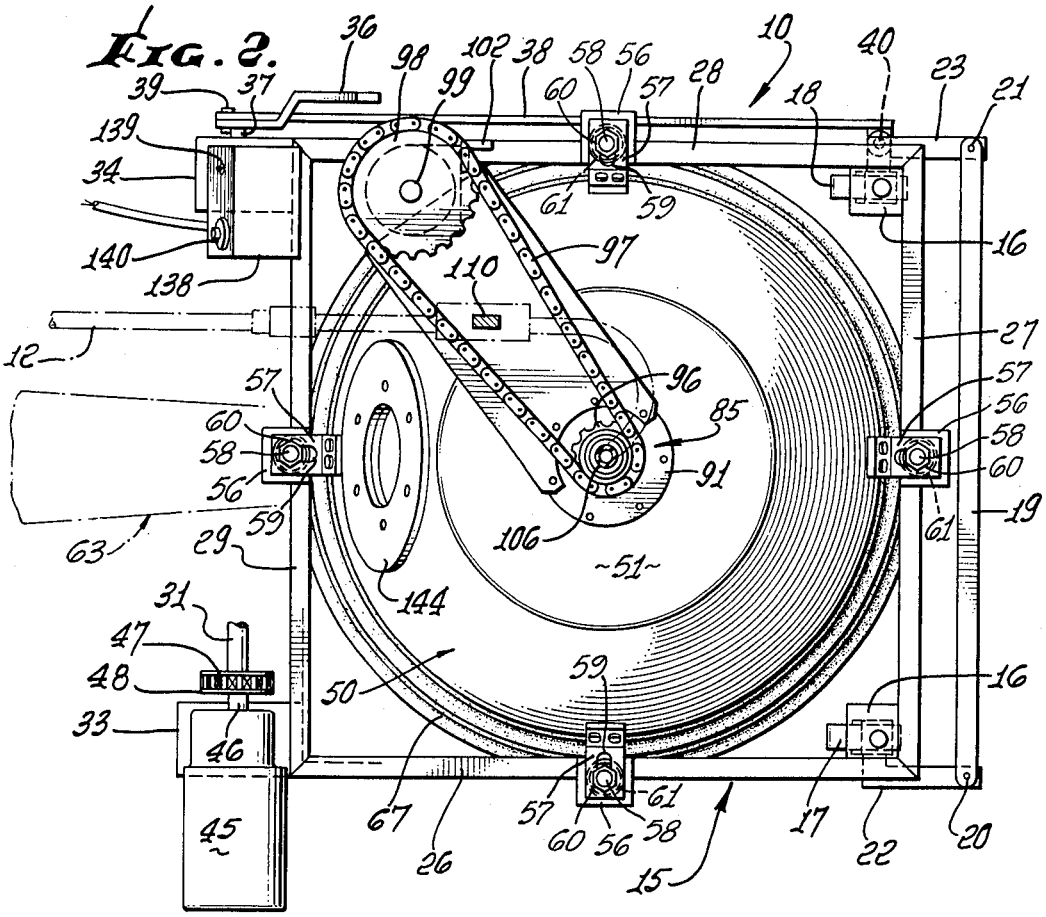
FIG. 2 is an overall plan view of the apparatus as seen along the line 2—2 of FIG. 1.

As best shown in FIG. 2, the vacuum cleaning device 10 includes a carriage, generally designated 15. Two forward corner plates 16 supporting forward dirigible wheels 17 and 18, respectively, are parts of a steering assembly that includes a forward crossbar 19. The opposite ends of crossbar 19 are pivotally attached by respective pins 20 and 21 to respective bell cranks 22 and 23 that control the orientation of the forward wheels 17 and 18. The carriage 15 has a square frame comprising horizontal beams 26, 27, 28 and 29 that rests at its foreportion on the plates 16.

Referring to FIGS. 1 and 2, drive wheels 30 on respective right and left sides of the square frame are carried by a common drive shaft 31. The drive shaft 31 is mounted on brackets 32 (FIG. 1) which in turn are carried by plates 33 and 34 on respective right and left hand sides of the square frame.

A manual steering lever 36 is mounted by a pivot pin 37 on the plate 34. A push-pull rod 38 is pivotally secured by a pin 39 to the lower end of the steering lever 36, the opposite end of the push-pull rod being secured by a pivot 40 to the bell crank 23 that guides wheel 18. Thus, the push-pull rod serves to rotate both bell cranks 22 and 23 to change the direction of the forward dirigible wheels 17 and 18.

A variable speed electric motor 45 is mounted on plate 33 and its shaft 46 carries a sprocket 47 which is connected by a sprocket chain 48 to a driven sprocket 49 (FIG. 1) that is keyed to drive shaft 31.

A hood 50 of frusto-conical form, which may be made of glass fibre reinforced by resin, has its open side facing downward to cooperate with the floor or work surface to serve as a mobile vacuum chamber. The hood is carried by the square frame consisting of the previously mentioned horizontal beams 26, 27, 28 and 29. The square frame has four clips 56 on its four sides, respectively, and the hood 50 has four corresponding brackets 57 spaced above the clips. As shown in FIGS. 1 and 1A, screw threaded posts 58 extend upward from the respective clips 56 through slots 59 in the brackets 57 and carry nuts 60 that bear against the upper sides of the brackets. Coil springs 61 surrounding the respective screws 58 act under compression between the clips and the brackets for yielding support of the hood.

A tapered diffuser 62 of an air jet pump, generally designated 63, is connected at its inlet end to the peripheral wall of the hood 50 and at its outer end is connected to the previously mentioned hose discharge 13. The previously mentioned hose 11 supplies compressed air to an annular jet nozzle 64 in the inlet end of the diffuser 62.

Figures 3, 4:
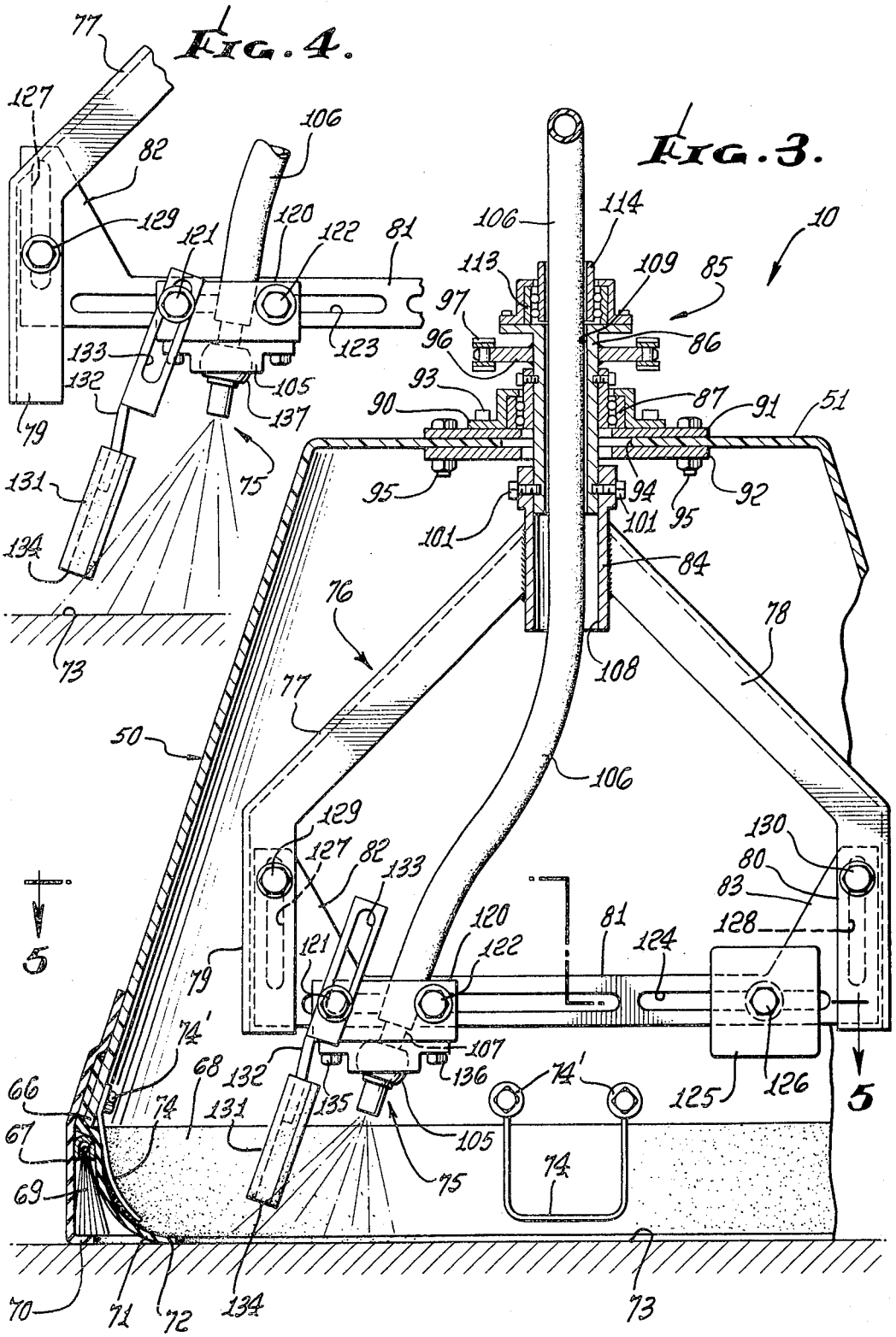
FIG. 3 is a fragmentary vertical sectional view taken along the line 3—3 of FIG. 1.
FIG. 4 is a fragmentary view similar to FIG. 3 with the orbiting air jet nozzle spaced a greater distance from the floor surface.

Referring to FIG. 3, the bottom rim 66 of the hood 50 is provided with a multiple seal consisting of a circumferential outer flexible rubber-like skirt 67, a circumferential inner flexible rubber-like skirt 68 and a circumferential brush 69. The brush 69 is sandwiched between the outer and inner flexible skirts and serves to reinforce the outer skirt against inward collapse. The outer flexible skirt 67 may be long enough so that a radially inward toe 70 can underlie the lower edge of the circumferential brush 69. The inner flexible skirt 68 is made such that an arcuate portion 71 extends radially inwardly from the rim 66 whereby to provide a tangential surface 72 capable of riding over the floor or work surface 73. U-shaped retaining springs 74 secured by bolts 74' on each of four sides of the rim 66 extend downwardly over the inner surface of the inner flexible skirt 68 for reinforcement thereof against inward collapse.

Agitation of debris on the floor surface is accomplished by an air jet nozzle 75 which is carried by a rotatable structure or frame that is indicated generally by reference numeral 76. The rotatable frame 76 comprises diagonal struts 77 and 78 terminating in lower respective leg portions 79 and 80. A transverse beam 81 interconnects the free ends of the leg portions 79 and 80, the connection being braced by gusset plates 82 and 83.

At their upper ends the diagonal struts 77 and 78 are welded to and supported by a collar 84. To rotationally mount the frame 76 on the upper end wall 51 of the hood, a composite bearing assembly indicated generally by the reference character 85 is provided. A tubular drive member 86 is rotatably mounted in a bearing 87 in the top wall of the hood. The bearing 87 rests on a washer 91 on the outer face of the top wall of the hood 50, and the washer 91 is connected to an inner washer 92 around an opening 94 in the hood by means of bolts 95.

A sprocket 96 integral with the tubular drive member 86 is engaged by a drive chain 97 that is driven by a drive sprocket 98 on a drive shaft 99 of a variable motor 100 for rotating the frame 76. The tubular drive member 86 supports the previously mentioned collar 84 of the rotatable frame 76 by means of screws 101. The motor 100 is supported on the previously mentioned horizontal beam 28 by a column 102.

In the present embodiment of the invention, the air jet nozzle 75 is moved in a circular orbit by the frame 76 but the air jet nozzle itself does not rotate on its own axis. Instead, a tiltable bearing 105 carried by the frame 76 rotates relative to the air jet nozzle 75 as the tiltable bearing is carried in an orbit by the frame 76. Thus, a flexible hose 106 which is a continuation of hose 12 need not itself rotate on its own axis. The flexible hose 106 is connected to a neck 107 of the air jet nozzle 75 and extends along the axis of rotation of the frame 76 through a passage 108 in the collar 84 and a bore 109 in the tubular drive member 86.

A bracket 110 on the upper side of the hood 50 carries a clamp 111 that grips the hose 106 to prevent rotation of the hose on the hose axis. A coupling 112 connects the flexible hose 106 to the supply line 12. A roller bearing 113 on the upper end of the tubular drive member 86 surrounds a collar 114 which embraces the flexible hose 106. The roller bearing 113 avoids imparting rotation of the hood to the hose.

Sundry adjustments are provided for the air jet nozzle 75 so that it can be moved closer to or farther away from the floor surface 73, or moved radially outwardly or inwardly with respect to the center of rotation of the frame 76, or moved to different angles of tilt.

Figure 5:
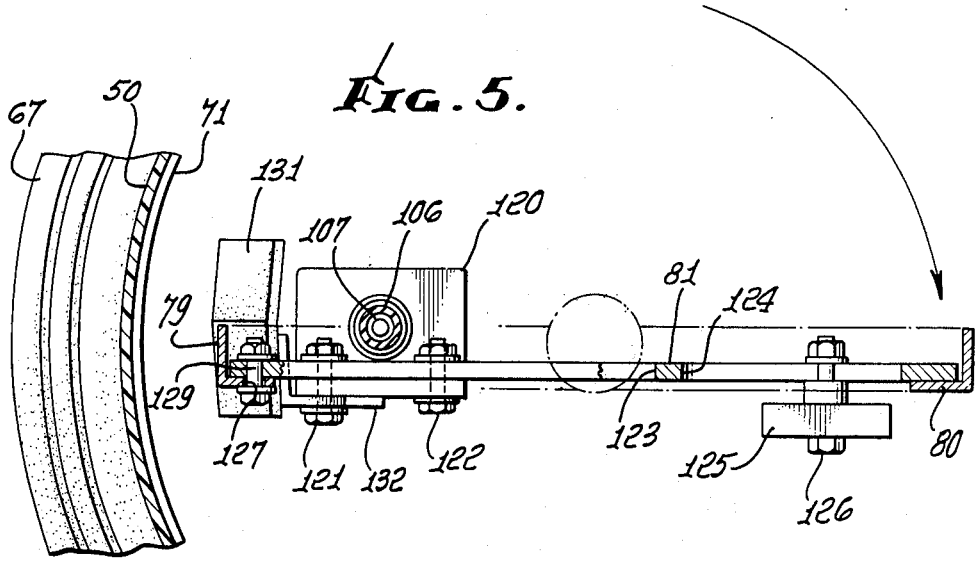
FIG. 5 is a horizontal sectional view taken along the line 5—5 of FIG. 3.

For changing the location of air jet nozzle 75 radially with respect to the axis of rotation of the frame 76, the tiltable bearing 105 is carried by an angular plate 120 shown in FIGS. 3 and 5 and the angular plate is attached to the transverse beam 81 by bolts 121 and 122. The bolts are adapted to slide in a slot 123 in the transverse beam 81 for adjustment at selected radial distances from the axis of rotation of the frame 76. A similar slot 124 on the opposite side of the transverse beam provides for adjustably positioning a counterweight 125 for the nozzle 75 by means of a bolt 126.

For moving the air jet nozzle 75 to different distances with respect to the floor surface 73, slots 127 and 128 are provided in the respective leg portions 79 and 80. Bolts 129 and 130 in the respective gusset plates 82 and 83 can be tightened or loosened as needed to permit the transverse beam 81 to be adjusted, for example, at the position shown in FIG. 3 or the higher position shown in FIG. 4.

A baffle 131 having a tiltable mounting shown in FIGS. 3 and 4 is secured by an arm 132 and a previously mentioned bolt 121 to the transverse beam 81. A slot 133 in the arm 132 permits the baffle 131 to be extended or retracted to position the baffle to protect the inner skirt 68 from the discharge of the air jet nozzle 75 regardless of the adjustment of the nozzle location. The same connection just described also permits the baffle to be tilted variously depending upon the position of the tilt of the nozzle 75. For tiltable adjustment of the air jet nozzle, bolts 135 and 136 are provided by means of which the ball-shaped body of the tiltable bearing 105 can be tightened or loosened, thereby to fix the axis of the bearing at a selected angle of adjustment.

A control box 138 of substantially conventional construction is provided to control both the variable speed motor 45 and the variable speed motor 100, suitable power being provided either by a power cord (not shown) or by a battery. Controls 139 and 140 on the control box 138 are manipulatable separately to vary the speed of travel of the hood over the floor surface and to vary the speed of rotation of the frame 76.

In operation, the device is guided on the wheels 17, 18 and 30 over the floor surface 73, the skirts 67 and 68 of the hood being kept in contact with the floor surface or close thereto. Although air under pressure is driven through the flexible hose 106 and the nozzle 75 into the interior of the hood, subatmospheric pressure is maintained in the hood by the air jet pump 63. The subatmospheric pressure inside the hood creates inward air flow under the hood to prevent any particles of debris from escaping outwardly from under the edge of the skirt of the hood.

The clearance of the two skirts 67 and 68 from the floor may be varied by adjusting the nuts 60 to raise or lower the hood 50 or may be varied by manually sliding up or down the portion of the skirt structure that embraces the hood.

While the invention has herein been shown and described in what is conceived to be a practical and effective embodiment, it is recognized that departures may be made therefrom within the scope of the invention, which is not to be limited to the details disclosed herein but is to be accorded the full scope of the claims so as to embrace any and all equivalent devices.

We claim:

1. In a vacuum cleaning device to remove debris from a surface, the combination of:
   - a hood supported on and movable along the surface and having its open side confronting the surface to form therewith a traveling vacuum chamber;
   - a nozzle in the hood directed towards the surface and mounted for circular orbital movement therein;
   - means to supply to the nozzle compressed air substantially free of entrained particles to agitate the debris on the surface;
   - means to withdraw air from the hood to maintain a vacuum therein and to entrain and withdraw the agitated particles of debris from the body; and
   - means for selectively adjusting the radius of said circular orbit.

2. In a vacuum cleaning device to remove debris from a surface, the combination of:
   - a hood supported on and movable along the surface and having its open side confronting the surface to form therewith a traveling vacuum chamber;
   - a nozzle supported for independent movement in the hood directed towards the surface;
   - means to supply to the nozzle compressed air substantially free of entrained particles to agitate the debris on the surface;
   - means to withdraw air from the hood to maintain a vacuum therein and to entrain and withdraw the agitated particles of debris from the hood;
   - a support structure carried by the hood,
   - said support structure including a first bearing having its axis substantially normal to said surface;
   - rotatable structure having a tubular portion rotatable in said bearing to support the rotatable structure;
   - a second bearing on the rotatable structure rotatably embracing said nozzle to permit relative rotation between the nozzle and the second bearing, the second bearing directing the nozzle towards said surface;

power means to drive the rotatable structure about said axis, said second bearing being spaced from said axis to carry the nozzle along an arcuate path in response to rotation of the rotatable structure; and a hose to supply the nozzle, a portion of the hose extending through said tubular portion of the rotatable structure along said axis with an end portion of the hose diverted from the axis to the nozzle in the second bearing.

3. A combination as set forth in claim 2 which includes means clamping said hose to resist rotation of said portion of the hose.

4. A combination as set forth in claim 2 in which said power means is a variable speed power means.

5. A combination as set forth in claim 2 which includes means to vary the radial distance of said second bearing from said axis.

6. A combination as set forth in claim 2 in which said power means continuously rotates the rotatable structure about said axis to move the nozzle continuously in a circular orbit.

7. A combination as set forth in claim 2 which includes a counterbalance for the nozzle, said counterbalance being mounted on said rotatable structure at a position diametrically opposite from the position of the second bearing.

8. A combination as set forth in claim 7 in which both said counterbalance and said second bearing are adjustable radially of said axis.

9. A combination as set forth in claim 8 in which said rotatable structure includes a pair of opposite arms diverging from said tubular portion at acute angles relative thereto, said two arms supporting said nozzle and said counterbalance.

10. A combination as set forth in claim 9 which includes a transverse bar interconnecting the outer ends of said two arms, the nozzle and the counterbalance being adjustably mounted on said transverse bar.

11. A combination as set forth in claim 1 which includes means below the hood to space the hood from said surface, said spacing means including roller means in rolling contact with the surface.

12. A combination as set forth in claim 11 in which the means to space the hood from the surface is a surrounding frame carried by said roller means.

13. A combination as set forth in claim 12 which includes power means on the frame to for driving said roller means to cause the hood to travel on said surface.

14. A combination as set forth in claim 13 in which said roller means includes dirigible roller means;

and which includes manual means to control the dirigible roller means to steer the hood.

15. A combination as set forth in claim 12 which includes means mounting the hood on said frame, said mounting means being yieldable to floatingly support the hood.

16. In a vacuum cleaning device to remove debris from a surface, the combination of:

a hood supported on and movable along the surface and having its open side confronting the surface to form therewith a traveling vacuum chamber;

a nozzle supported for independent movement in the hood directed towards the surface;

means to supply to the nozzle compressed air substantially free of entrained particles to agitate the debris on the surface;

means to withdraw air from the hood to maintain a vacuum therein and to entrain and withdraw the agitated particles of debris from the hood;

means below the hood to space the hood from said surface, said spacing means including roller means in rolling contact with the surface;

the means to space the hood from the surface being a surrounding frame carried by said roller means; and mounting means to support the hood on the frame, said mounting means being adjustable to vertically vary the hood position on the frame, and by such variance the height of the hood above the subjacent surface.

17. In a vacuum cleaning device to remove debris from a surface, the combination of:

a hood supported on and movable along the surface and having its open side confronting the surface to form therewith a traveling vacuum chamber;

a nozzle supported for independent movement in the hood directed towards the surface;

means to supply to the nozzle compressed air substantially free of entrained particles to agitate the debris on the surface;

means to withdraw air from the hood to maintain a vacuum therein and to entrain and withdraw the agitated particles of debris from the hood;

means below the hood to space the hood from said surface, said spacing means including roller means in rolling contact with the surface;

the means to space the hood from the surface being a surrounding frame carried by said roller means;

means mounting the hood on said frame, said mounting means including:

a plurality of peripherally spaced apertured brackets on the outer surface of the hood;

a corresponding plurality of screw threaded posts on the frame extending upward through the corresponding apertured brackets;

a corresponding plurality of coil springs surrounding the screw threaded posts in axial compression between the brackets and the frame; and a corresponding plurality of nuts on the posts bearing against the upper sides of the brackets.

18. In a vacuum cleaning device to remove debris from a surface, the combination of:

a hood supported on and movable along the surface and having its open side confronting the surface to form therewith a traveling vacuum chamber;

a nozzle supported for independent movement in the hood directed towards the surface;

means to supply to the nozzle compressed air substantially free of entrained particles to agitate the debris on the surface;

means to withdraw air from the hood to maintain a vacuum therein and to entrain and withdraw the agitated particles of debris from the hood;

means below the hood to space the hood from said surface, said spacing means including roller means in rolling contact with the surface;

skirt means extending from the hood toward said surface, said skirt means embracing the hood and being slidingly and vertically adjustable relative to the hood to vary the extent that the skirt extends towards said surface.

19. In a vacuum cleaning device to remove debris from a surface, the combination of:

a hood supported on and movable along the surface and having its open side confronting the surface to form therewith a traveling vacuum chamber;

a nozzle supported for independent movement in the hood directed towards the surface;

means to supply to the nozzle compressed air substantially free of entrained particles to agitate the debris on the surface;

means to withdraw air from the hood to maintain a vacuum therein and to entrain and withdraw the agitated particles of debris from the hood;

means below the hood to space the hood from said surface, said spacing means including roller means in rolling contact with the surface;

a rubber-like skirt extending downward from the hood toward said surface;

and which includes baffle means movable with the nozzle to protect said skirt means from abrasion by the stream from the nozzle.

* * * * *

UNITED STATES PATENT AND TRADEMARK OFFICE

CERTIFICATE OF CORRECTION

PATENT NO. : 4,037,290

DATED : July 26, 1977

INVENTOR(S) : James J. Rose and Edward L. Horton

It is certified that error appears in the above-identified patent and that said Letters Patent are hereby corrected as shown below:

Column 2, line 4, "blast" should read --air jet--;
line 53, delete "a rate";
line 58, after "high" insert --a rate--;
line 64, "This versatility of the apparatus" should read --The invention--.

Column 3, lines 5 and 6, "With the present apparatus functioning as a" should read --Using the present--;
lines 8-10, delete "After the accumulated ***apparatus".

Column 7, line 52 (claim 13, line 2), delete "to".

Signed and Sealed this

*Eighteenth* Day of *October 1977*

[SEAL]

*Attest:*

RUTH C. MASON
*Attesting Officer*

LUTRELLE F. PARKER
*Acting Commissioner of Patents and Trademarks*